US011427001B2

(12) United States Patent
Kashiwagi

(10) Patent No.: US 11,427,001 B2
(45) Date of Patent: Aug. 30, 2022

(54) HEAD MAINTENANCE DEVICE, LIQUID DISCHARGE APPARATUS, AND PRINTER

(71) Applicant: Ricoh Company, Ltd., Tokyo (JP)

(72) Inventor: Kenta Kashiwagi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/159,239

(22) Filed: Jan. 27, 2021

(65) Prior Publication Data

US 2021/0245513 A1 Aug. 12, 2021

(30) Foreign Application Priority Data

Feb. 6, 2020 (JP) ..... JP2020-018550

(51) Int. Cl.
*B41J 2/165* (2006.01)

(52) U.S. Cl.
CPC ..... *B41J 2/16505* (2013.01); *B41J 2/16535* (2013.01)

(58) Field of Classification Search
CPC ..... B41J 2/16505; B41J 2/16535; B41J 2/16538; B41J 2/16541; B41J 2/16547; B41J 2/16552
See application file for complete search history.

(56) References Cited

U.S. PATENT DOCUMENTS 9,517,629 B2 * 12/2016 Kuno ..... B41J 2/16538
2007/0200893 A1 * 8/2007 Nakashima ..... B41J 2/16547 347/33
2010/0067934 A1 * 3/2010 Mihara ..... B41J 2/1721 399/71
2010/0245462 A1 * 9/2010 Seino ..... B41J 2/16544 347/31
2018/0361761 A1 12/2018 Okeguchi et al.
2020/0094582 A1 3/2020 Okeguchi et al.

FOREIGN PATENT DOCUMENTS

JP 11-020187 1/1999
JP 2001-071519 3/2001
JP 2011-025621 2/2011

* cited by examiner

*Primary Examiner* — Sharon Polk
(74) *Attorney, Agent, or Firm* — Xsensus LLP

(57) ABSTRACT

A head maintenance device includes a cap configured to cap a nozzle surface of a head configured to discharge a liquid, a wiper configured to wipe the nozzle surface of the head, a holder configured to vertically movably hold the cap and the wiper to a height at which the cap and the wiper bite into the absorbing member, and a cleaner configured to move relative to the cap and the wiper, the cleaner comprising an absorbing member configured to contact the cap and the wiper.

18 Claims, 13 Drawing Sheets

HEAD MAINTENANCE DEVICE, LIQUID DISCHARGE APPARATUS, AND PRINTER

CROSS-REFERENCE TO RELATED APPLICATION

This patent application is based on and claims priority pursuant to 35 U.S.C. § 119(a) to Japanese Patent Application No. 2020-018550, filed on Feb. 6, 2020, in the Japan Patent Office, the entire disclosures of which is hereby incorporated by reference herein.

BACKGROUND

Technical Field

Aspects of the present disclosure relate to a head maintenance device, a liquid discharge apparatus, and a printer.

Related Art

A liquid discharge apparatus includes a head and a head maintenance device (maintenance and recovery device). The head discharges a liquid from nozzles formed on a nozzle surface of the head. The head maintenance device includes a cap to cap the nozzle surface of the head and a wiper to wipe the nozzle surface, for example.

The liquid discharge apparatus includes a cleaner including a web-shaped wiper cleaner that cleans a contact surface of the cap to be contact with the nozzle surface of the head and cleans a top surface and a side wall surface of the wiper.

SUMMARY

In an aspect of this disclosure, A head maintenance device includes a cap configured to cap a nozzle surface of a head configured to discharge a liquid, a wiper configured to wipe the nozzle surface of the head, a holder configured to vertically movably hold the cap and the wiper to a height at which the cap and the wiper bite into the absorbing member, and a cleaner configured to move relative to the cap and the wiper, the cleaner comprising an absorbing member configured to contact the cap and the wiper.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
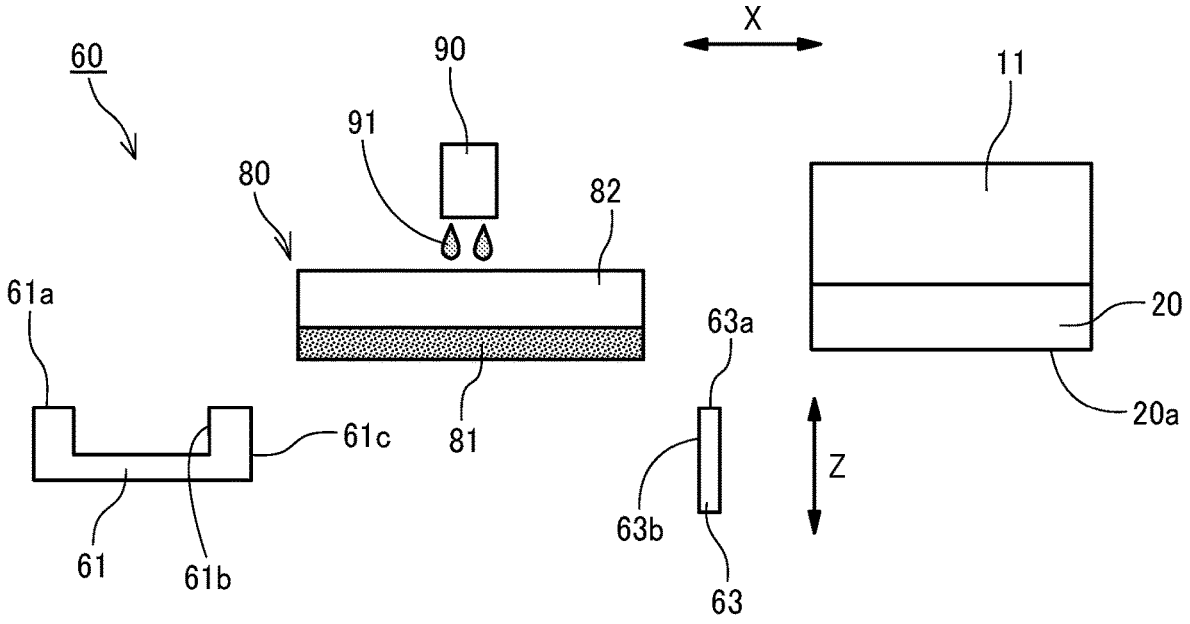
FIG. 1 is a schematic side view of a head maintenance device according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

A liquid discharge apparatus according to an embodiment of the present disclosure is described with reference to the accompanying drawings.

Referring now to the drawings, wherein like reference numerals designate identical or corresponding parts throughout the several views, embodiments of the present disclosure are described below. A first embodiment of the present disclosure is described with reference to FIG. 1.

FIG. 1 is a schematic side view of a head maintenance device 60 according to a first embodiment of the present disclosure.

The head maintenance device 60 includes a suction cap 61, a wiper 63, a cleaner 80, and a cleaning liquid application device 90. The suction cap 61 also serves as a moisture-retention cap. The wiper 63 has a shape of a blade and serves as a wiping member.

The suction cap 61 caps a nozzle surface 20*a* of the head 20 that discharges a liquid. The head maintenance device 60 includes a suction device such as a suction pump connected to the suction cap 61. The head 20 is mounted on a carriage 11 that reciprocally moves in a direction indicated by arrow "X" in FIG. 1. The wiper 63 wipes the nozzle surface 20*a* of the head 20.

The suction cap 61 and the wiper 63 are vertically movable in a direction indicated by arrow Z in FIG. 1.

The cleaner 80 includes a holder 82 and an absorbing member 81 held by the holder 82. The cleaner 80 is movable in the direction X. The cleaner 80 is movable between a cap contacting position at which the absorbing member 81 can contact a contact surface 61*a*, an inner side wall surface 61*b*, and an outer side wall surface 61*c* of the suction cap 61, and a wiper contacting position at which the adsorbing member 81 can contact the wiper 63 in the head maintenance device 60 according to the first embodiment.

The inner side wall surface 61*b* and the outer side wall surface 61*c* of the suction cap 61 forms side wall surfaces of the suction cap 61.

Further, the cleaner 80, the suction cap 61, and the wiper 63 are arranged such that the cleaner 80 is interposed between the suction cap 61 and the wiper 63 in the head maintenance device 60 according to the first embodiment. Specifically, the suction cap 61, the cleaner 80, the wiper 63, and the head 20 are arranged from left to right in this order in the direction X in FIG. 1.

Hardness of the absorbing member 81 is lower than hardness of the suction cap 61. The suction cap 61 is pressed against the absorbing member 81 so that the suction cap 61 can bite into the absorbing member 81. Thus, the absorbing member 81 can clean the inner side wall surface 61*b* and the outer side wall surface 61*c* of the suction cap 61.

Further, a width of the absorbing member 81 is made wider than a width of the suction cap 61 in a longitudinal direction of the suction cap 61, that is, in the direction X. Thus, the absorbing member 81 can clean an entire area of the suction cap 61 including the contact surface 61*a* and a part of the side wall surface (the inner side wall surface 61*b* and the outer side wall surface 61*c*) of the suction cap 61 by one movement of the absorbing member 81. The width of the suction cap 61 becomes a width in the longitudinal direction of the suction cap 61 or a width in a transverse (short) direction of the suction cap 61 according to a direction of a relative movement of the absorbing member 81 with respect to the suction cap 61.

Although the absorbing member 81 has a rectangular parallelepiped shape in the first embodiment as illustrated in FIG. 1, the absorbing member 81 may have a shape of a rotating body. Further, the absorbing member 81 may be a brush.

The cleaning liquid application device 90 applies a cleaning liquid 91 to the absorbing member 81 of the cleaner 80 from a side (upper side in FIG. 1) opposite to a side (lower side in FIG. 1) in contact with the suction cap 61 and the wiper 63 of the absorbing member 81.

The cleaner 80 and the cleaning liquid application device 90 are movable between a cleaning position as illustrated in FIG. 1 and an evacuation position at which the cleaner 80 and the cleaning liquid application device 90 are retracted from a moving range of the carriage 11. Thus, the cleaner 80 and the cleaning liquid application device 90 are retracted from a moving range of the carriage 11 when the wiper 63 wipes the nozzle surface 20*a* of the head 20 and when the suction cap 61 or the like caps the nozzle surface 20*a* of the head 20.

Next, a cleaning operation in the head maintenance device 60 according to the first embodiment is described with reference to FIGS. 2A to 2C.

Figure 2A:
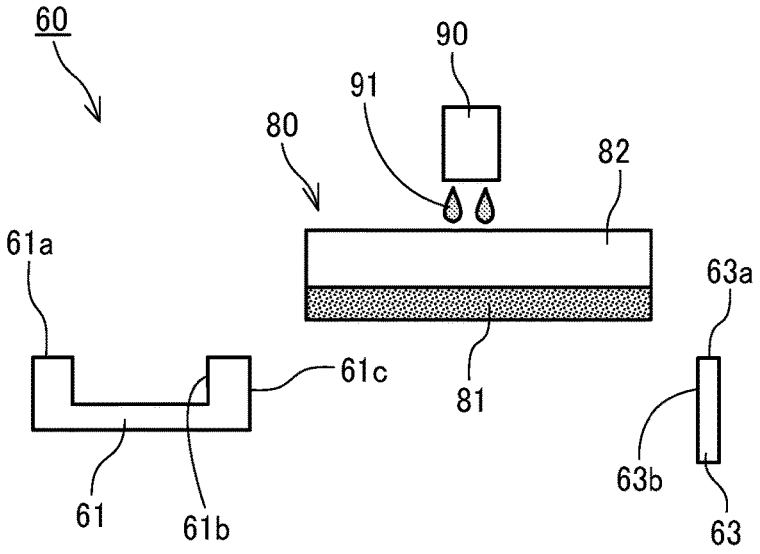
FIGS. 2A to 2C are schematic side views of the head maintenance device to illustrate a cleaning operation according to the first embodiment.
Figure 2B:
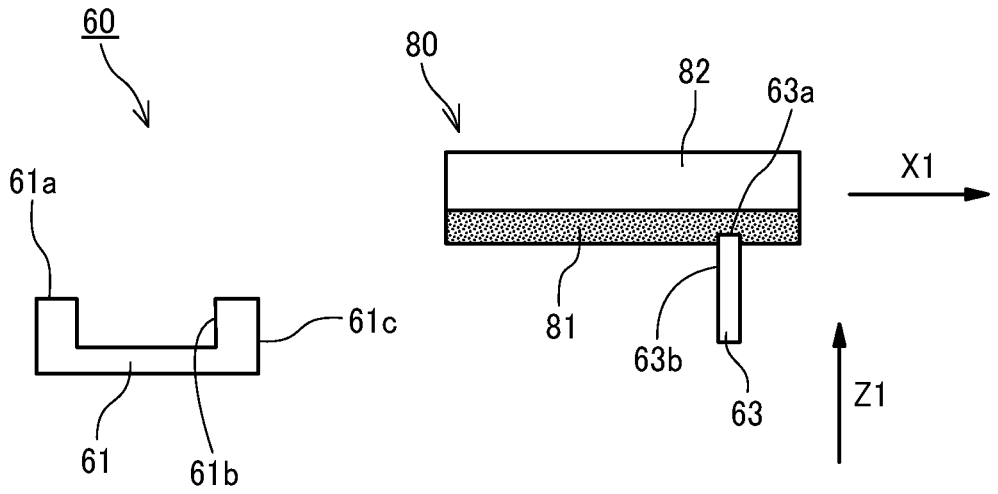
Figure 2C:
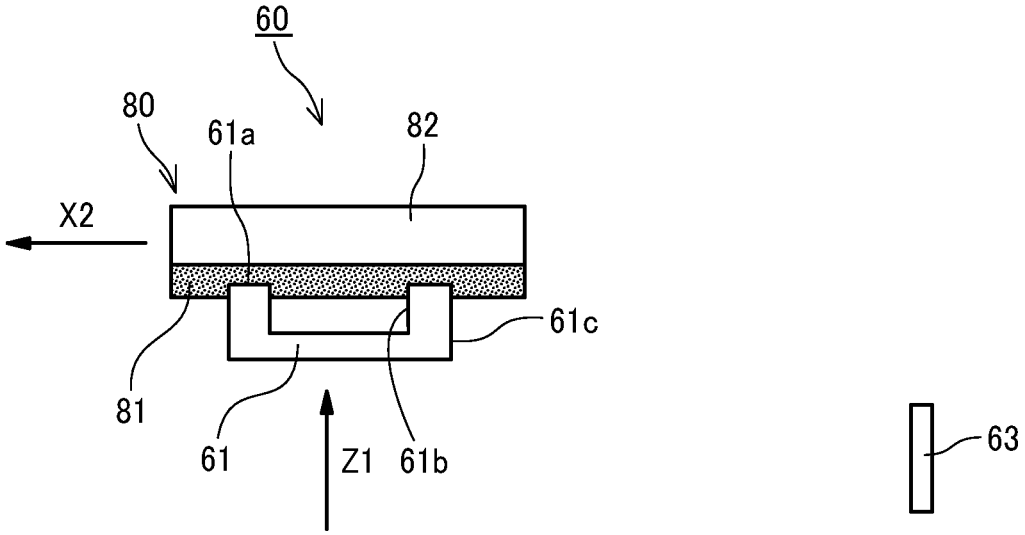

FIGS. 2A to 2C are schematic side views of the head maintenance device 60 to illustrate the cleaning operation according to the first embodiment.

As illustrated in FIG. 2A, the cleaner 80 moves to the cleaning liquid application device 90 so that the cleaning liquid application device 90 applies (supplies) the cleaning liquid 91 to the upper side of the absorbing member 81 of the cleaner 80.

Then, as illustrated in FIG. 2B, the wiper 63 is raised in a direction indicated by arrow "Z1", and the cleaner 80 moves in a direction indicated by arrow "X1". Thus, the absorbing member 81 absorbs and removes a liquid remaining on a top surface 63*a* and a part of a side wall surface 63*b* of the wiper 63. Thus, the cleaner 80 can clean the wiper 63. A part of the side wall surface 63*b* of the wiper 63 forms a part of the top surface 63*a* of the wiper 63.

Then, as illustrated in FIG. 2C, the suction cap 61 is raised in the direction Z1. At this time, the suction cap 61 is raised to a height at which the contact surface 61*a*, a part of the inner side wall surface 61*b*, and a part of the outer side wall surface 61*c* of the suction cap 61 bite into the absorbing member 81. A part of the inner side wall surface 61*b* and a part of the outer side wall surface 61*c* of the suction cap 61 form a part of the contact surface 61*a* of the suction cap 61.

Then, as the cleaner 80 moves in a direction X2, the absorbing member 81 also moves in the direction X2 while the contact surface 61*a*, the inner side wall surface 61*b*, and the outer side wall surface 61*c* of the suction cap 61 bite into the absorbing member 81.

Thus, the absorbing member 81 absorbs and removes the liquid remaining on the contact surface 61*a*, a part of the inner side wall surface 61*b*, and a part of the outer side wall surface 61*c* of the suction cap 61. Thus, the cleaner 80 can clean the suction cap 61.

Thus, the head maintenance device 60 moves the absorbing member 81 of the cleaner 80 to come into contact with the suction cap 61 and the wiper 63 as the wiping member to clean the suction cap 61 and the wiper 63.

The contact surface 61*a*, the inner side wall surface 61*b*, and the outer side wall surface 61*c* of the suction cap 61 bite into the absorbing member 81 while the cleaner 80 moves in the direction X2 so that the cleaner 80 can clean not only the contact surface 61*a* but also the inner side wall surface 61*b* and the outer side wall surface 61*c* of the suction cap 61. Thus, the head maintenance device 60 can remove the liquid remaining on a part of the inner side wall surface 61*b* and a part of the outer side wall surface 61*c* of the suction cap 61.

Thus, the head maintenance device 60 can improve a cleanability of the cleaner 80 to clean the suction cap 61 and the wiper 63.

Next, the head maintenance device 60 according to a second embodiment of the present disclosure is described with reference to FIGS. 3A and 3B.

Figure 3A:
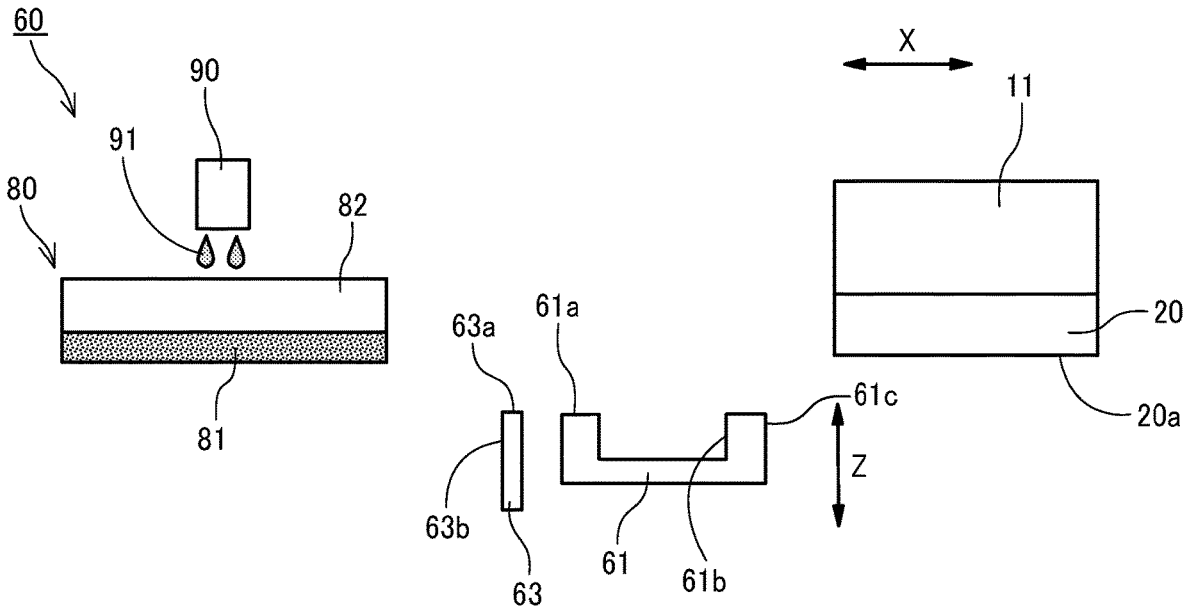
FIGS. 3A and 3B are schematic side views of the head maintenance device according to a second embodiment of the present disclosure.
Figure 3B:
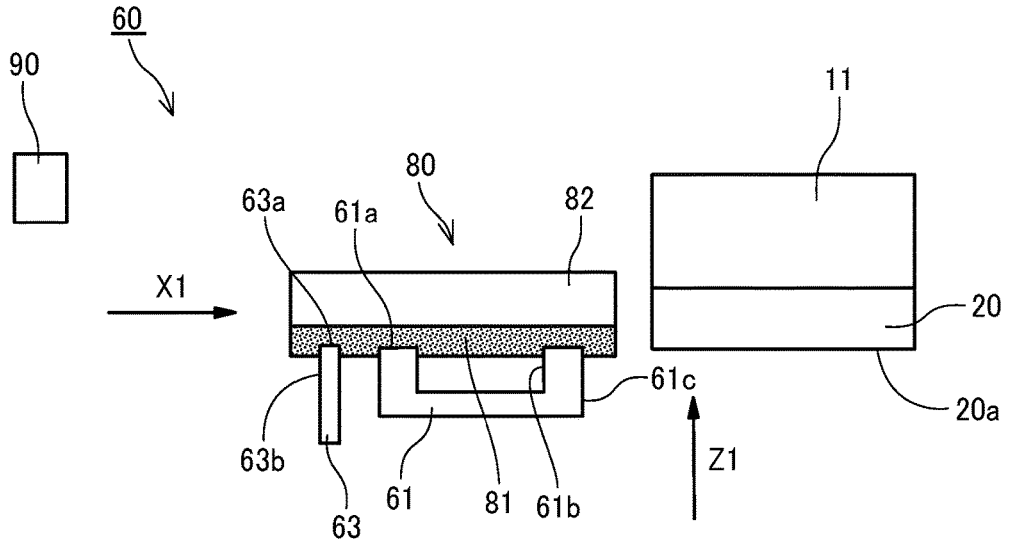

FIGS. 3A and 3B are schematic side views of the head maintenance device 60 according to the second embodiment of the present disclosure.

The head maintenance device 60 according to the second embodiment includes the suction cap 61 and the wiper 63 arranged adjacent to each other in the direction X. Further, the head maintenance device 60 includes the cleaner 80 on a left side of the wiper 63 in the direction X in FIG. 3A. The cleaner 80, the wiper 63, and the suction cap 61 are arranged from left to right in this order in FIG. 3A in a moving direction of the cleaner 80 as indicated by arrow X1 in FIG. 3B. Specifically, the cleaner 80, the wiper 63, the suction cap 61, and the head 20 are arranged from left to right in the direction X in FIG. 3A. Thus, the wiper 63 and the suction cap 61 are disposed between the cleaner 80 and the head 20.

When the cleaner 80 cleans the suction cap 61 and the wiper 63, the cleaning liquid application device 90 applies a cleaning liquid 91 to the absorbing member 81 of the cleaner 80 as illustrated in FIG. 3A. Then, as illustrated in FIG. 3B, the suction cap 61 and the wiper 63 are raised in the direction Z1.

At this time, similarly to the first embodiment, the suction cap 61 and the wiper 63 are raised to a height at which the contact surface 61*a*, the part of the inner side wall surface 61*b*, and the part of the outer side wall surface 61*c* of the suction cap 61, and the top surface 63*a* and the side wall surface 63*b* of the wiper 63 bite into the absorbing member 81 as illustrated in FIG. 3B.

Then, as illustrated in FIG. 3B, the head maintenance device 60 moves the cleaner 80 in the direction X1 so that the absorbing member 81 moves in the direction X1 while the top surface 63*a* and the part of the side wall surface 63*b* of the wiper 63, the contact surface 61*a*, the part of the inner side wall surface 61*b*, and the part of the outer side wall surface 61*c* of the suction cap 61 bite into the absorbing member 81.

Thus, the absorbing member 81 absorbs and removes the liquid remaining on the top surface 63*a* and the part of the side wall surface 63*b* of the wiper 63, the contact surface 61*a*, the part of the inner side wall surface 61*b*, and the part of the outer side wall surface 61*c* of the suction cap 61 to clean the suction cap 61 and the wiper 63.

Thus, the head maintenance device 60 moves the cleaner 80 in one direction to clean the wiper 63 and the suction cap 61.

Next, the head maintenance device 60 according to a third embodiment of the present disclosure is described with reference to FIGS. 4A and 4B.

Figure 4A:
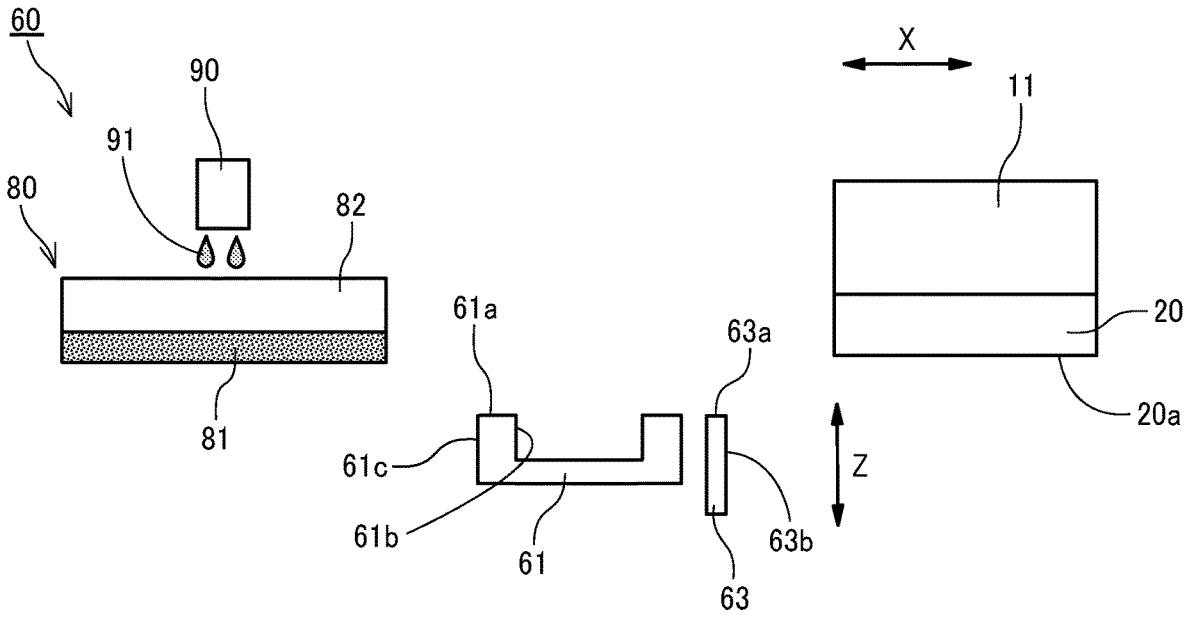
FIGS. 4A and 4B are schematic side views of the head maintenance device according to a third embodiment of the present disclosure.
Figure 4B:
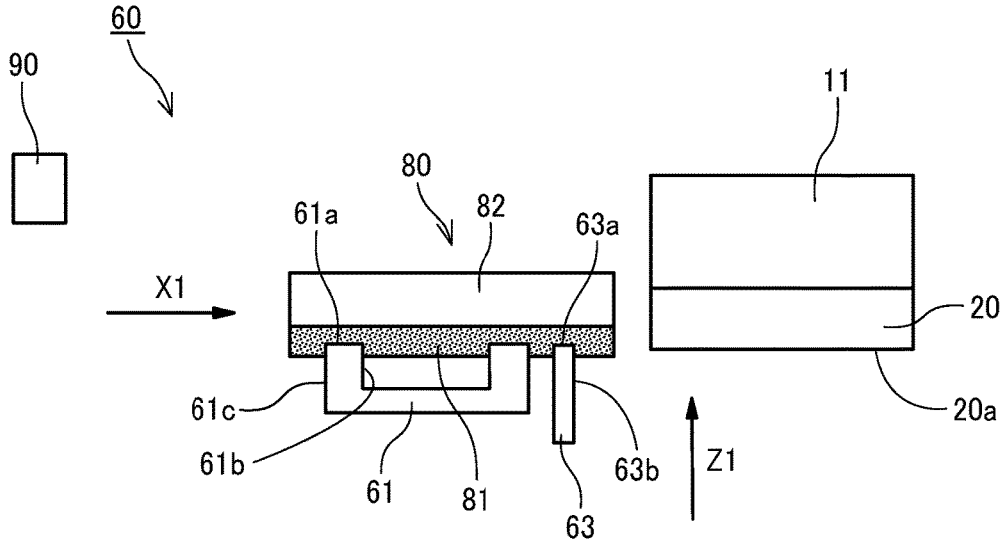

FIGS. 4A and 4B are schematic side views of the head maintenance device 60 according to the third embodiment of the present disclosure.

The head maintenance device 60 according to the third embodiment includes the suction cap 61 and the wiper 63 arranged adjacent to each other so that the cleaner 80 is arranged on a left side of the suction cap 61 in FIG. 4A. The cleaner 80, the suction cap 61, and the wiper 63 are arranged from left to right in this order in FIG. 4A in a moving direction of the cleaner 80 as indicated by arrow X1 in FIG. 4A. Specifically, the cleaner 80, the suction cap 61, the wiper 63, and the head 20 are arranged from left to right in the direction X1 in FIG. 4A. Thus, the suction cap 61 and the wiper 63 are disposed between the cleaner 80 and the head 20.

As similar to the second embodiment, when the cleaner 80 cleans the suction cap 61 and the wiper 63, the cleaning liquid application device 90 applies a cleaning liquid 91 to the absorbing member 81 of the cleaner 80 as illustrated in FIG. 4A in the third embodiment. Then, as illustrated in FIG. 4B, the suction cap 61 and the wiper 63 are raised in the direction Z1.

At this time, similarly to the second embodiment, the suction cap 61 and the wiper 63 are raised to the height at which the contact surface 61*a*, the part of the inner side wall surface 61*b*, and the part of the outer side wall surface 61*c* of the suction cap 61, and the top surface 63*a* and the side wall surface 63*b* of the wiper 63 bite into the absorbing member 81 as illustrated in FIG. 4B.

Then, as illustrated in FIG. 4B, the head maintenance device 60 moves the cleaner 80 in the direction X1 so that the absorbing member 81 moves in the direction X1 while the contact surface 61*a*, the part of the inner side wall surface 61*b*, and the part of the outer side wall surface 61*c* of the suction cap 61, the top surface 63*a* and the part of the side wall surface 63*b* of the wiper 63 bite into the absorbing member 81.

Thus, the absorbing member 81 absorbs and removes the liquid remaining on the contact surface 61*a*, the part of the inner side wall surface 61*b*, and the part of the outer side wall surface 61*c* of the suction cap 61, and the top surface 63*a* and the part of the side wall surface 63*b* of the wiper 63 to clean the suction cap 61 and the wiper 63.

Thus, the head maintenance device 60 moves the cleaner 80 in one direction to clean the suction cap 61 and the wiper 63.

In each of the above embodiments, the head maintenance device 60 moves the absorbing member 81 of the cleaner 80 in the direction X1 after raising the suction cap 61 and the wiper 63 in the direction Z1 to perform a cleaning operation. However, the head maintenance device 60 may perform the cleaning operation in a reversed order.

That is, the head maintenance device 60 may perform the cleaning operation in the reversed order such that the head maintenance device 60 individually or simultaneously raises the suction cap 61 and the wiper 63 in the direction Z1 after moving the absorbing member 81 of the cleaner 80 to a cleaning position at which the suction cap 61 and the wiper 63 are pressed against the absorbing member 81 and bite into the absorbing member 81 to absorb and remove the remaining liquid on the suction cap 61 and the wiper 63 to the absorbing member 81.

The cleaner 80 moves in a horizontal direction (directions X1 and X2) to clean the suction cap 61 and the wiper 63. The direction X1 is a rightward direction in FIG. 2B, 3B, and 4B, and the direction X2 is a leftward direction in FIG. 2C.

Next, a fourth embodiment of the present disclosure is described with reference to FIGS. 5A and 5B.

Figure 5A:
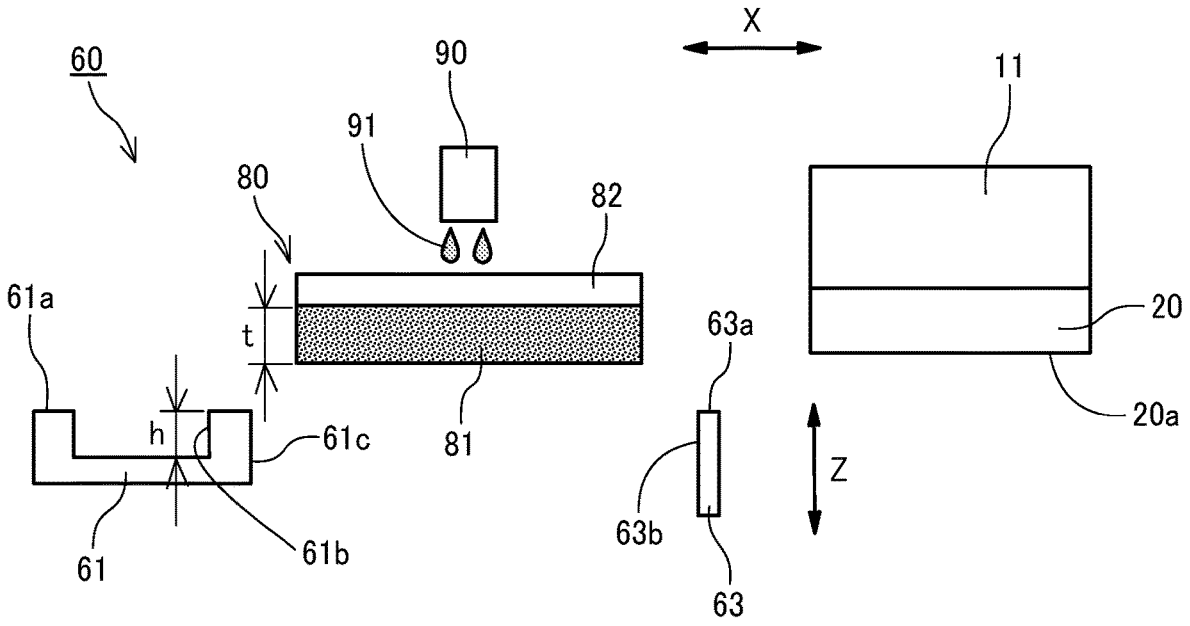
FIGS. 5A and 5B are schematic side views of the head maintenance device according to a fourth embodiment of the present disclosure.
Figure 5B:
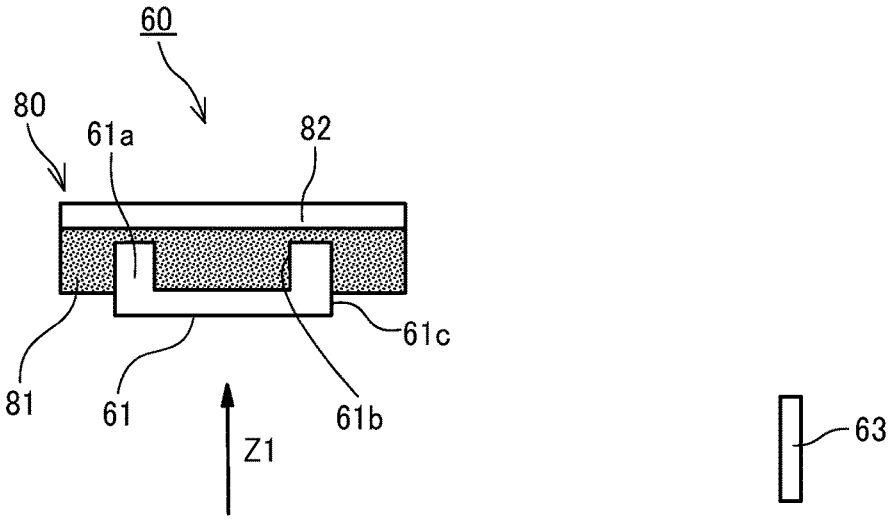

FIGS. 5A and 5B are schematic side views of the head maintenance device 60 according to the fourth embodiment of the present disclosure.

The head maintenance device 60 according to the fourth embodiment includes the absorbing member 81 having a thickness "t" that is made larger than a height "h" of the inner side wall surface 61*b* of the suction cap 61.

Thus, as illustrated in FIG. 5B, the cleaner 80 can press the absorbing member 81 to a bottom surface of the suction cap 61 to clean the suction cap 61. That is, the cleaner 80 can clean the liquid remaining on an entire inner side wall surface 61*b* of the suction cap 61 including the bottom surface of the suction cap 61. The cleaner 80 can also reliably clean the outer side wall surface 61*c* of the suction cap 61 that becomes dirty to the same height as the inner side wall surface 61*b* of the suction cap 61.

In FIG. 5B, a thickness "t" of the absorbing member 81 is 1.2 times or more, preferably 1.5 times or more, of a height "h" of the inner side wall surface 61*b* of the suction cap 61.

Although the fourth embodiment illustrated in FIGS. 5A and 5B are describe using the first embodiment, relationship between the absorbing member 81 and the suction cap 61 according to the second embodiment and the third embodiments can be similarly applied to the fourth embodiment.

Next, the head maintenance device 60 according to a fifth embodiment of the present disclosure is described with reference to FIGS. 6A to 6C.

Figure 6A:
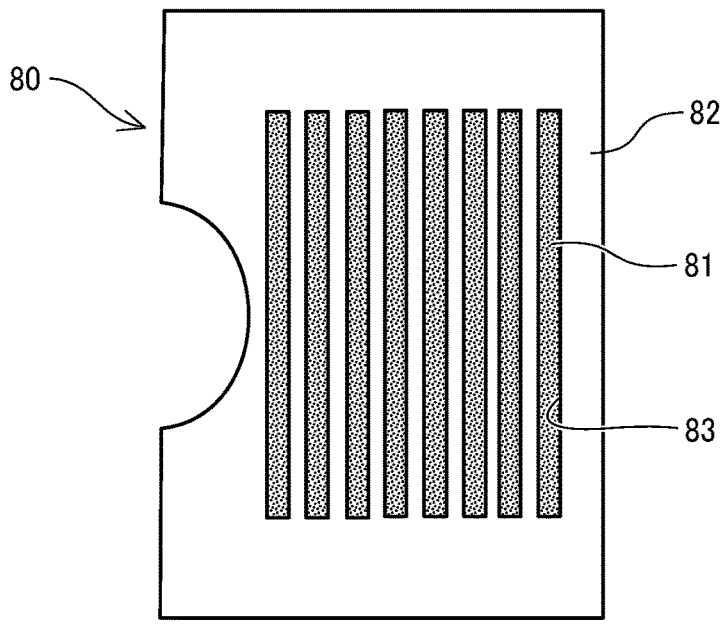
FIGS. 6A to 6C are schematic plan view and side views of a cleaner of the head maintenance device according to a fifth embodiment of the present disclosure.
Figure 6B:
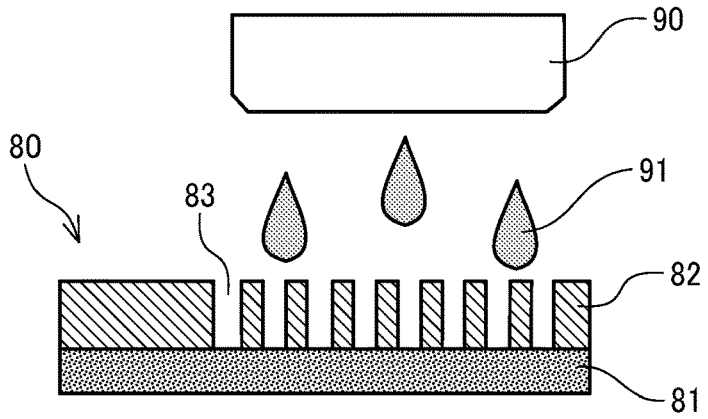
Figure 6C:
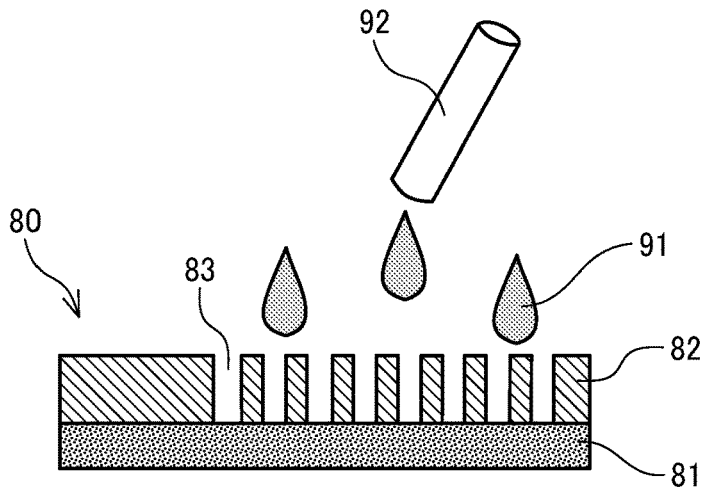

FIGS. 6A to 6C are schematic plan view and side views of the cleaner 80 of the head maintenance device 60 according to the fifth embodiment of the present disclosure.

The cleaner 80 includes a holder 82 and a plurality of slits 83 in the holder 82. The holder 82 holds the absorbing member 81. The plurality of slits 83 penetrates through the holder 82 of the cleaner 80. The holder 82 is also referred to as a "cleaner holder."

Thus, it is visible a dirt on the holder 82 of the cleaner 80 even if the holder 82 is made of an opaque member. Thus, it becomes easier for the user to grasp time for replacing the cleaner 80.

Further, as illustrated in FIG. 6B, the cleaning liquid application device 90 may drop (apply) the cleaning liquid 91 on the plurality of slits 83 of the holder 82 so that the cleaning liquid 91 flows through the plurality of slits 83 and is supplied to the absorbing member 81. Alternatively, as illustrated in FIG. 6C, the cleaning liquid application device 90 may use a dropper 92 to drop the cleaning liquid 91 on the plurality of slits 83 of the holder 82 so that the cleaning liquid 91 flows through the plurality of slits 83 and is supplied to the absorbing member 81.

Thus, the absorbing member 81 becomes a containing state in which the absorbing member 81 contains the cleaning liquid 91, and a cleanability of the absorbing member 81 in the containing state becomes larger than a cleanability of the absorbing member 81 not in the containing state (not contain the cleaning liquid 91).

Thus, the cleaner 80 includes the holder 82 (cleaner holder) including the slits 83 penetrating through the holder 82, and one surface of the absorbing member 81 is attached to the holder 82, and another surface of the absorbing member 81 contacts the suction cap 61 and the wiper 63.

Further, the cleaning liquid application device 90 applies the cleaning liquid 91 to one surface of the absorbing member 81 opposite to another surface of the absorbing member 81 contacting the suction cap 61 and the wiper 63.

Next, the head maintenance device 60 according to a sixth embodiment of the present disclosure is described with reference to FIGS. 7 and 8.

Figure 7:
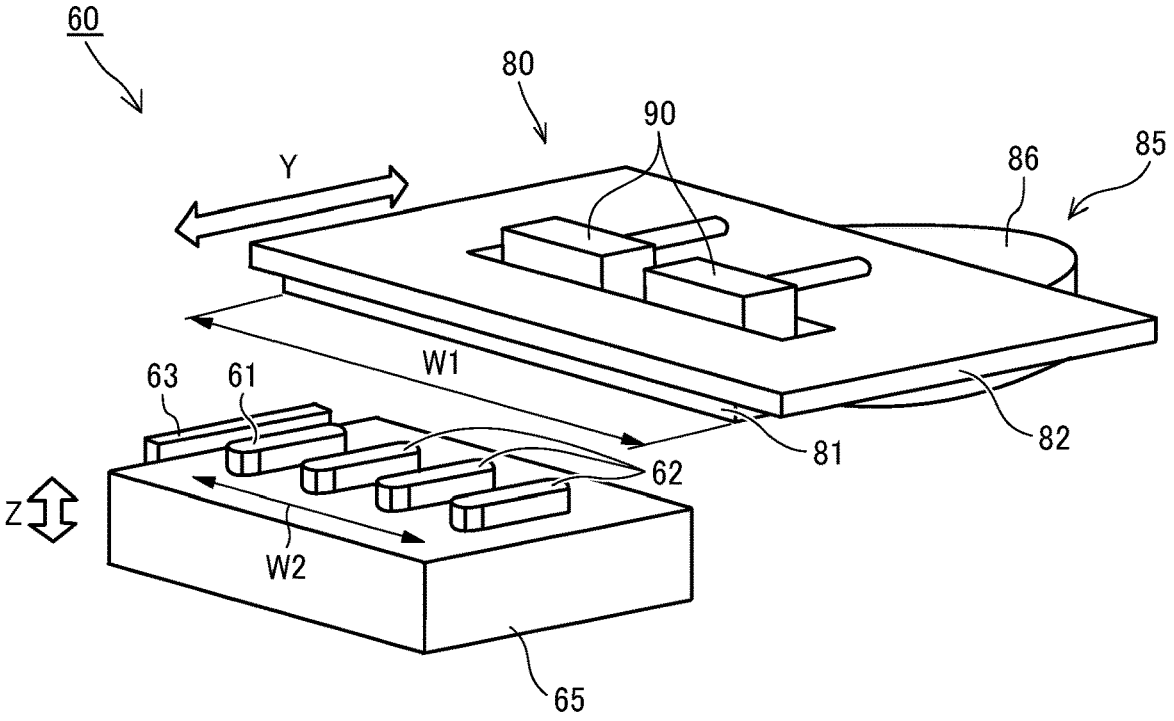
FIG. 7 is a schematic perspective view of the head maintenance device according to a sixth embodiment as seen from above.

FIG. 7 is a schematic perspective view of the head maintenance device 60 according to the sixth embodiment as seen from above.

Figure 8:
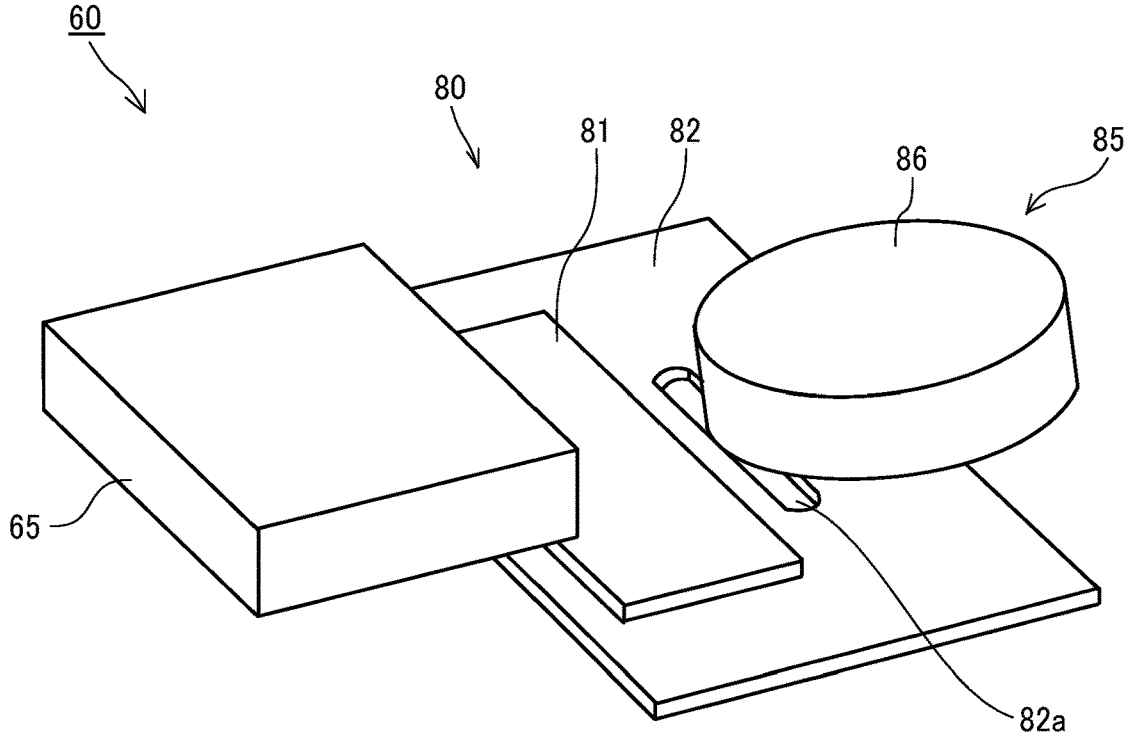
FIG. 8 is a schematic perspective view of the head maintenance device according to the sixth embodiment as seen from below.

FIG. 8 is a schematic perspective view of the head maintenance device 60 according to the sixth embodiment as seen from below.

The head maintenance device 60 according to the sixth embodiment includes a maintenance holder 65 to vertically movably hold the suction cap 61, three moisture-keeping caps 62, and the wiper 63. The maintenance holder 65 is elevatable (vertically movable) in the direction Z so that the suction cap 61, three moisture-keeping caps 62, and the wiper 63 are vertically movable in the direction Z. The maintenance holder 65 may also be simply referred to as the "holder."

The cleaner 80 includes a moving device 85 that holds a rectangular parallelepiped absorbing member 81 on the holder 82 and moves the absorbing member 81 together with the holder 82.

The moving device 85 includes a cam 86 that moves the holder 82 in a direction indicated by arrow "Y" (hereinafter, also referred to as "direction Y"). The cam 86 is engaged with an engaging groove 82*a* in the holder 82. The cam 86 is rotated to move the absorbing member 81 between a cleaning position at which the absorbing member 81 contacts the suction cap 61 and the wiper 63 and a retracting position at which the absorbing member 81 does not contact the wiper 63 and the wiper 63.

In the sixth embodiment, a width W1 of the absorbing member 81 is wider than a width W2 of a plurality (here four) of caps including the suction caps 61 and the moisture-keeping caps 62 in an arrangement direction of the plurality of caps.

Thus, the head maintenance device 60 can clean a plurality of caps including the suction cap 61 and the moisture-keeping cap 62 with a single pressing operation.

Next, a cleaning operation in the head maintenance device 60 according to the first embodiment is described with reference to FIG. 9.

Figure 9:
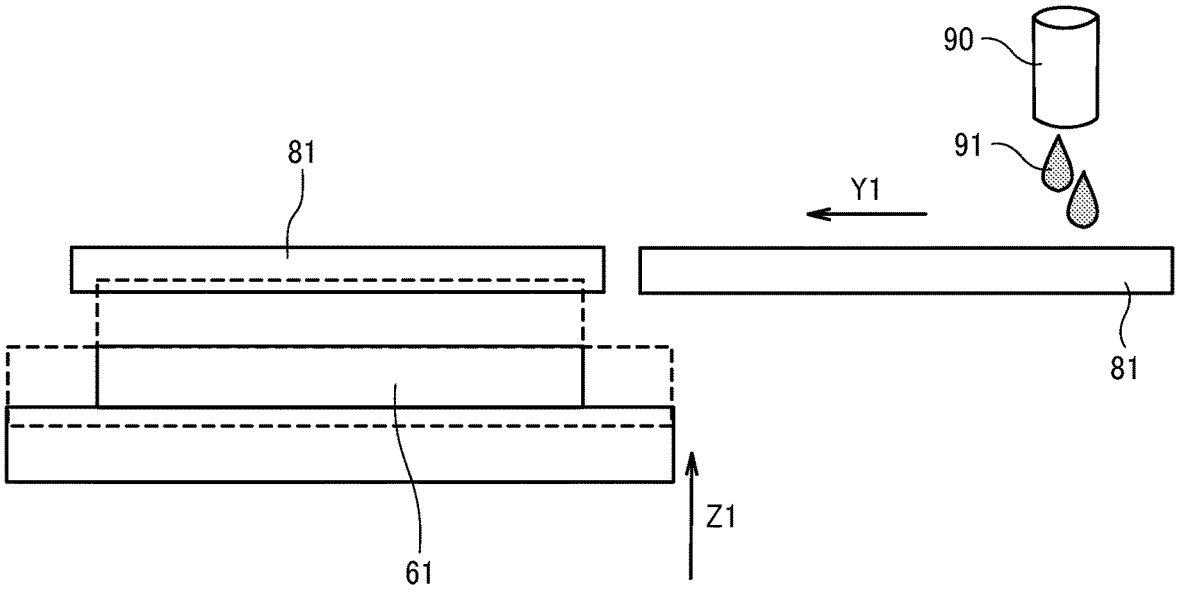
FIG. 9 is a side view of the head maintenance device illustrating the cleaning operation in the sixth embodiment.

FIG. 9 is a side view of the head maintenance device 60 illustrating the cleaning operation. Although reference numerals of the respective parts of the suction cap 61 and the wiper 63 are omitted in FIG. 9, the reference numerals are the same as the reference numerals in the first embodiment and the like (the same applies to the following embodiments).

As illustrated in FIGS. 7 to 9, the cam 86 of the moving device 85 is rotated to move the absorbing member 81 of the cleaner 80 in a direction indicated by arrow "Y1" to the cleaning position at which the absorbing member 81 faces the suction cap 61, the wiper 63, and the like. Then, the suction cap 61, the wiper 63, and the like are raised in the direction Z1 and are pressed against the absorbing member 81 until the suction cap 61, the wiper 63, and the like bite into the absorbing member 81.

Thus, the absorbing member 81 absorbs and removes the liquid remaining on the contact surface 61*a* and the part of the inner side wall surface 61*b* of the suction cap 61, and the top surface 63*a* and the part of the side wall surface 63*b* of the wiper 63 to clean the suction cap 61, the wiper 63, and the like.

The head maintenance device 60 according to a seventh embodiment of the present disclosure is described with reference to FIGS. 10 and 11.

Figure 10:
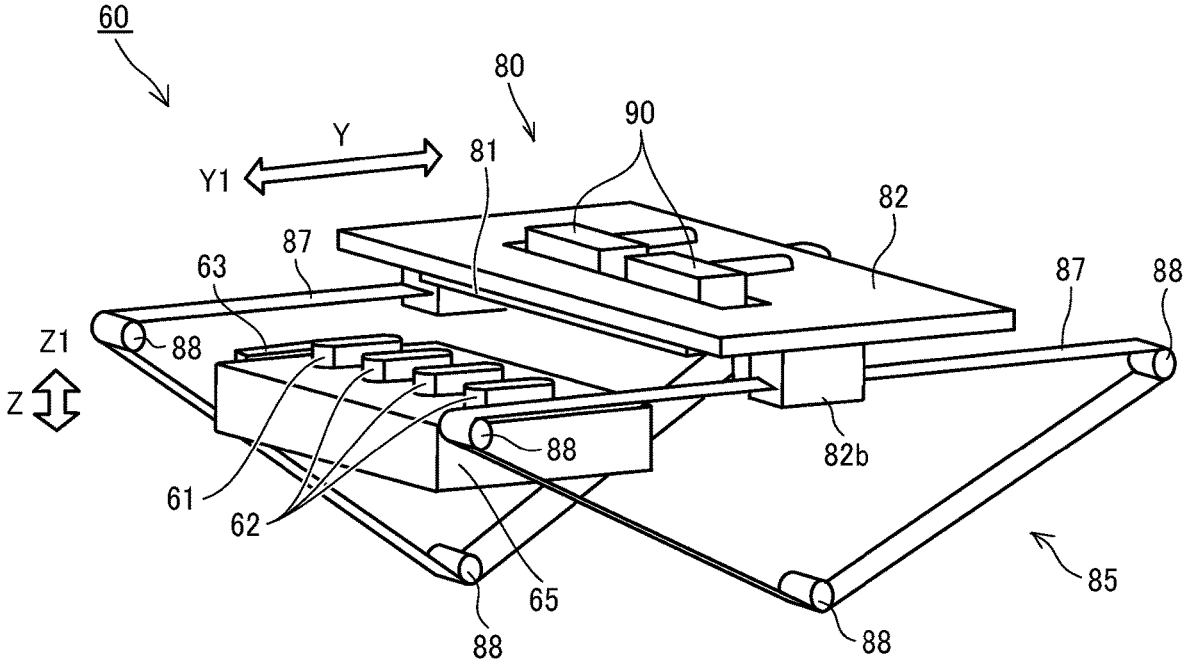
FIG. 10 is a schematic perspective view of the head maintenance device according to a seventh embodiment as seen from above.

FIG. 10 is a schematic perspective view of the head maintenance device 60 according to the seventh embodiment as seen from above.

Figure 11:
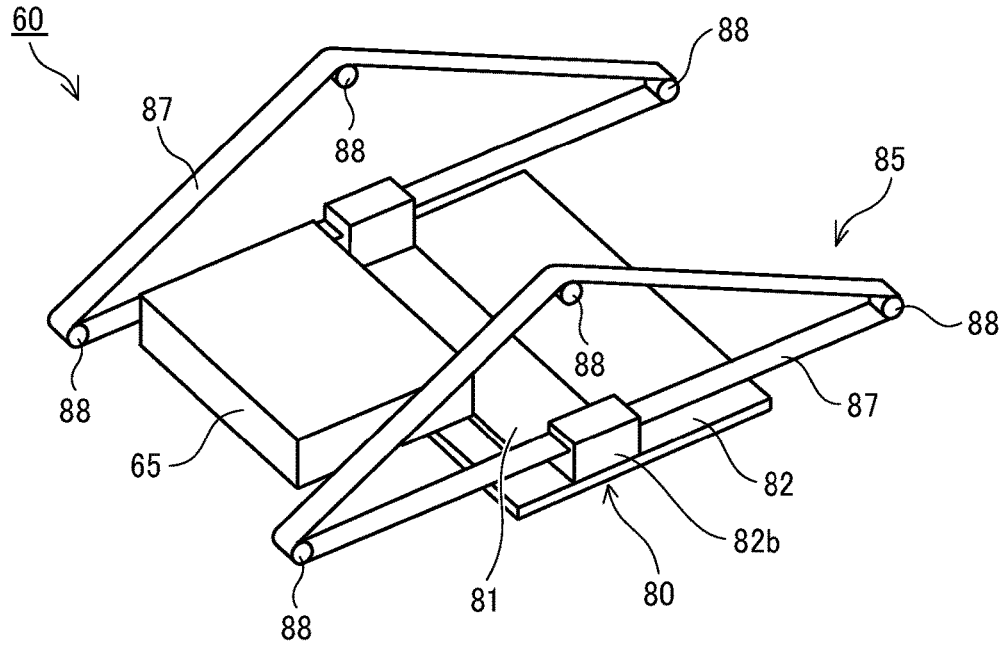
FIG. 11 is a schematic perspective view of the head maintenance device according to the seventh embodiment as seen from below.

FIG. 11 is a schematic perspective view of the head maintenance device 60 according to the seventh embodiment as seen from below.

The cleaner 80 includes a moving device 85 that moves the absorbing member 81 together with the holder 82. The moving device 85 includes an endless belt 87 looped around a plurality of rollers 88. The moving device 85 includes a connecting portion 82*b* of the holder 82 connected to the belt 87.

The belt 87 of the moving device 85 is moved around the rollers 88 to move the absorbing member 81 between a cleaning position at which the absorbing member 81 contacts the suction cap 61 and the wiper 63 and a retracting position at which the absorbing member 81 does not contact the suction cap 61 and the wiper 63.

As illustrated in FIGS. 10 and 11, the belt 87 of the moving device 85 is rotated around the rollers 88 to move the absorbing member 81 of the cleaner 80 in the direction Y1 to the position at which the absorbing member 81 faces the suction cap 61, the wiper 63, and the like. Then, the suction cap 61, the wiper 63, and the like are raised in the direction Z1 and are pressed against the absorbing member 81 until the suction cap 61, the wiper 63, and the like bite into the absorbing member 81.

Alternatively, after the suction cap 61, the wiper 63, and the like are raised in the direction Z1, the belt 87 of the moving device 85 is moved around the rollers 88 to move the absorbing member 81 of the cleaner 80 in the direction Y1.

Thus, the absorbing member 81 absorbs and removes the liquid remaining on the contact surface 61*a* and the part of the inner side wall surface 61*b* of the suction cap 61, and the top surface 63*a* and the part of the side wall surface 63*b* of the wiper 63 to clean the suction cap 61, the wiper 63, and the like.

The head maintenance device 60 according to an eighth embodiment of the present disclosure is described with reference to FIGS. 12 and 13.

Figure 12:
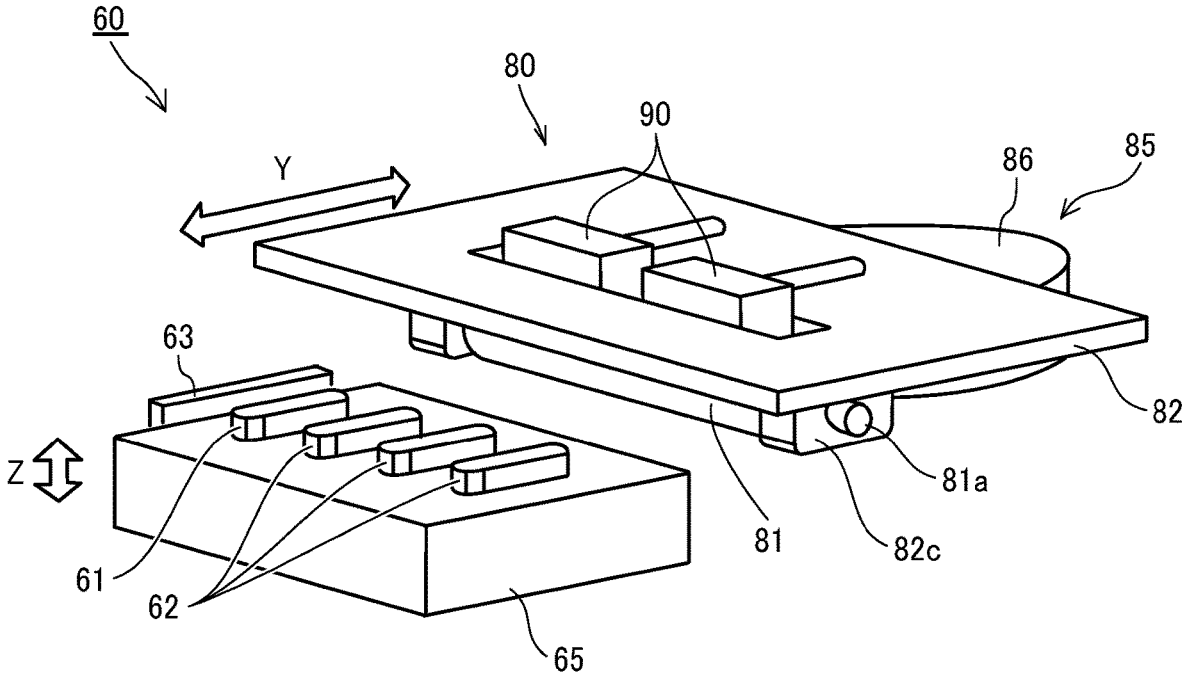
FIG. 12 is a schematic perspective view of the head maintenance device according to an eighth embodiment as seen from above.

FIG. 12 is a schematic perspective view of the head maintenance device 60 according to the eighth embodiment as seen from above.

Figure 13:
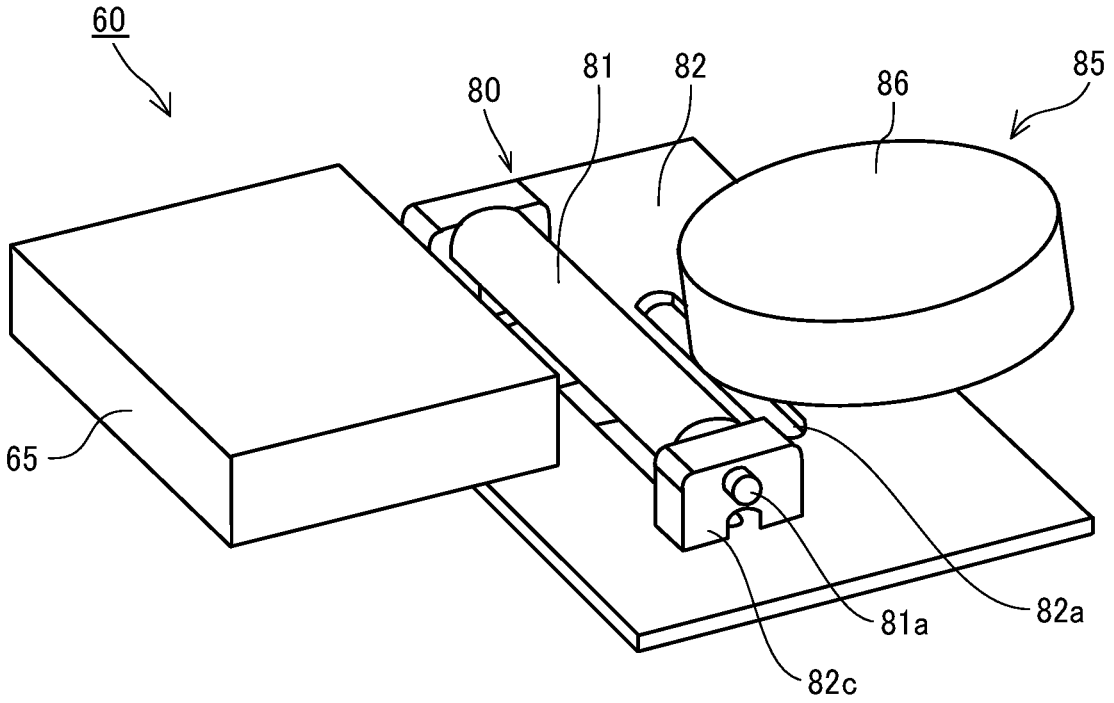
FIG. 13 is a schematic perspective view of the head maintenance device according to the eighth embodiment as seen from below.

FIG. 13 is a schematic perspective view of the head maintenance device 60 according to the eighth embodiment as seen from below.

The head maintenance device 60 according to the eighth embodiment includes the absorbing member 81 of the cleaner 80 in the sixth embodiment (see FIGS. 7 and 8) having a roller shape. The holder 82 includes flanges 82*c* that rotatably hold both ends of a shaft 81*a* of the absorbing member 81.

Next, a cleaning operation in the head maintenance device 60 according to the eighth embodiment is described with reference to FIG. 14.

Figure 14:
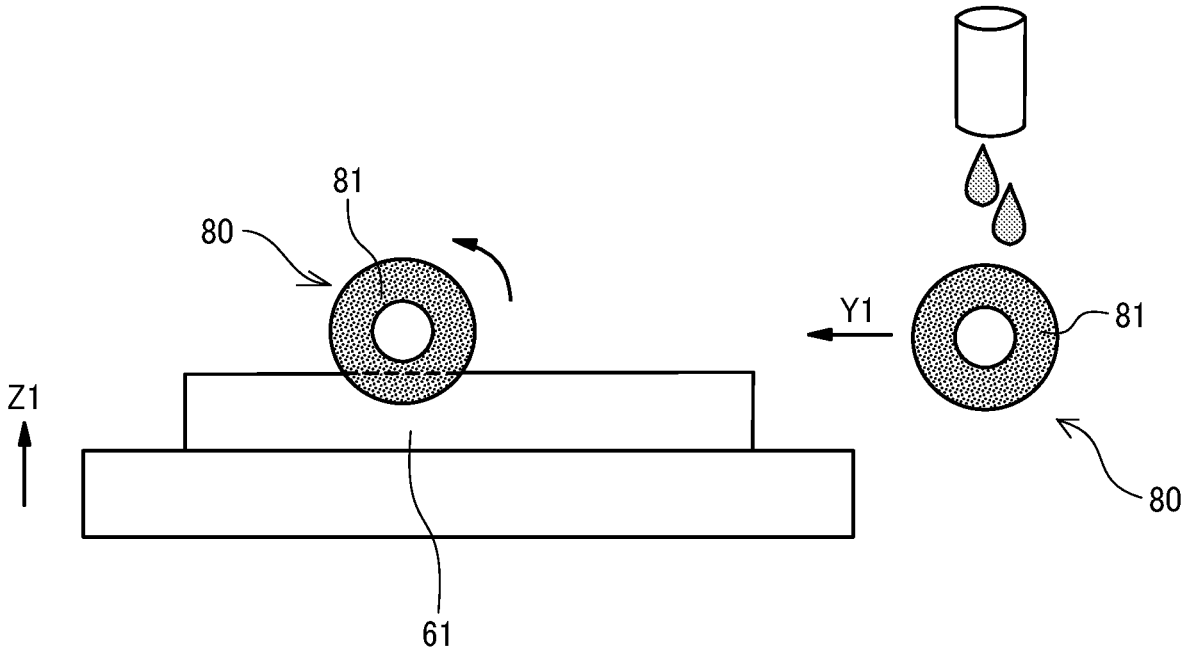
FIG. 14 is a side view of the head maintenance device illustrating the cleaning operation.

FIG. 14 is a side view of the head maintenance device 60 illustrating the cleaning operation.

When the cleaner 80 cleans the suction cap 61, the wiper 63, and the like as illustrated in FIG. 14, the cleaner 80 applies the cleaning liquid 91 to the absorbing member 81 and raise the suction cap 61 and the wiper 63 to a height at which the suction cap 61 and the wiper 63 bite into the absorbing member 81 in the direction Z1. Then, the cam 86 of the moving device 85 is rotated to move the absorbing member 81 of the cleaner 80 in the direction Y1 to the cleaning position.

At this time, the absorbing member 81 moves while the suction cap 61, the wiper 63, and the like bite into the absorbing member 81. Thus, the absorbing member 81 absorbs and removes the liquid remaining on the contact surface 61*a* and the part of the inner side wall surface 61*b* of the suction cap 61, and the top surface 63*a* and the part of the side wall surface 63*b* of the wiper 63 to clean the suction cap 61, the wiper 63, and the like.

The head maintenance device 60 according to a ninth embodiment of the present disclosure is described with reference to FIGS. 15 and 16.

Figure 15:
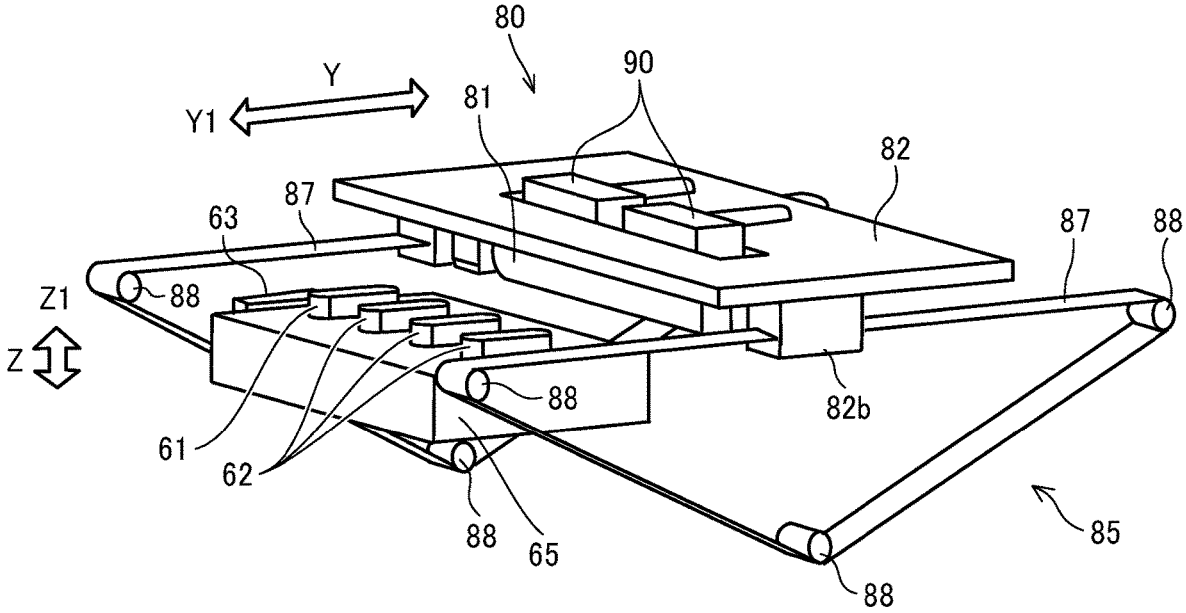
FIG. 15 is a schematic perspective view of the head maintenance device according to a ninth embodiment as seen from above.

FIG. 15 is a schematic perspective view of the head maintenance device 60 according to the ninth embodiment as seen from above.

Figure 16:
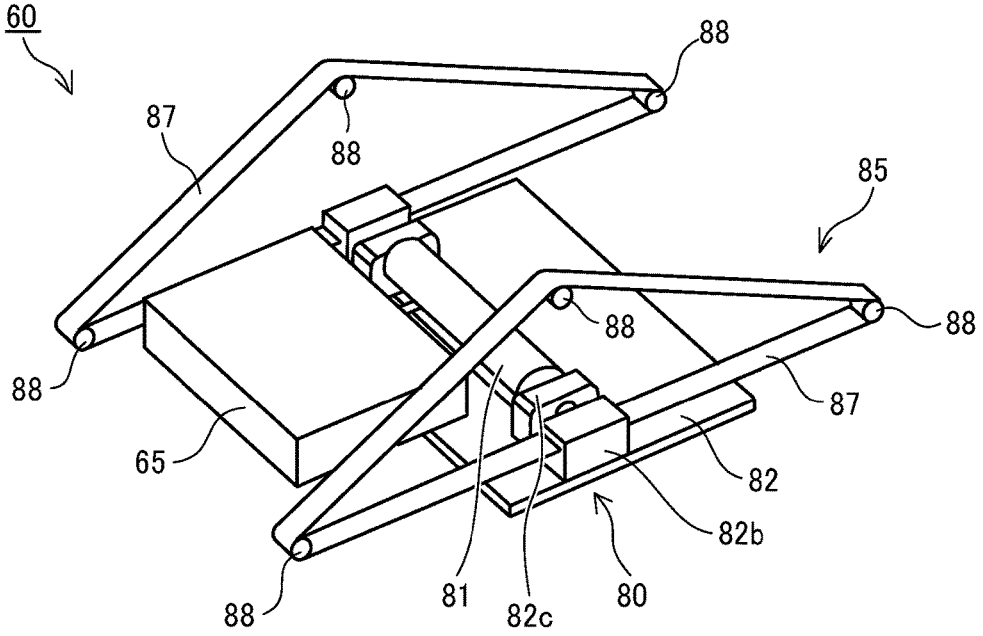
FIG. 16 is a schematic perspective view of the head maintenance device according to the ninth embodiment as seen from below.

FIG. 16 is a schematic perspective view of the head maintenance device 60 according to the ninth embodiment as seen from below.

The head maintenance device 60 according to the ninth embodiment includes the absorbing member 81 of the cleaner 80 in the seventh embodiment (see FIGS. 10 and 11) having a roller shape. The holder 82 includes flanges 82*c* that rotatably hold both ends of the shaft 81 a of the absorbing member 81.

When the cleaner 80 cleans the suction cap 61, the wiper 63, and the like as illustrated in FIG. 15, the cleaner 80 applies the cleaning liquid 91 to the absorbing member 81 and raise the suction cap 61 and the wiper 63 to a height at which the suction cap 61 and the wiper 63 bite into the absorbing member 81 in the direction Z1 as in the above-described eighth embodiment (see FIGS. 12 and 13). Then, the belt 87 of the moving device 85 is rotated around the rollers 88 to move the absorbing member 81 of the cleaner 80 in the direction Y1 to the cleaning position.

At this time, the absorbing member 81 moves in the direction Y1 while the suction cap 61, the wiper 63, and the like bite into the absorbing member 81. Thus, the absorbing member 81 absorbs and removes the liquid remaining on the contact surface 61*a* and the part of the inner side wall surface 61*b* of the suction cap 61, and the top surface 63*a* and the part of the side wall surface 63*b* of the wiper 63 to clean the suction cap 61, the wiper 63, and the like.

In the sixth to ninth embodiments (see FIGS. 7 to 16), the absorbing member 81 may move in a short direction (direction X) of the suction cap 61 as in the first embodiment (see FIGS. 1 and 2). Similarly, in the first to third embodiments (see FIGS. 1 to 4), the absorbing member 81 may move in a longitudinal direction (direction Y) of the suction cap 61 as in the sixth embodiment (see FIGS. 7 to 9).

Next, an example of a printer 1 as a liquid discharge apparatus according to an embodiment of the present disclosure is described with reference to FIGS. 17 to 19.

Figure 17:
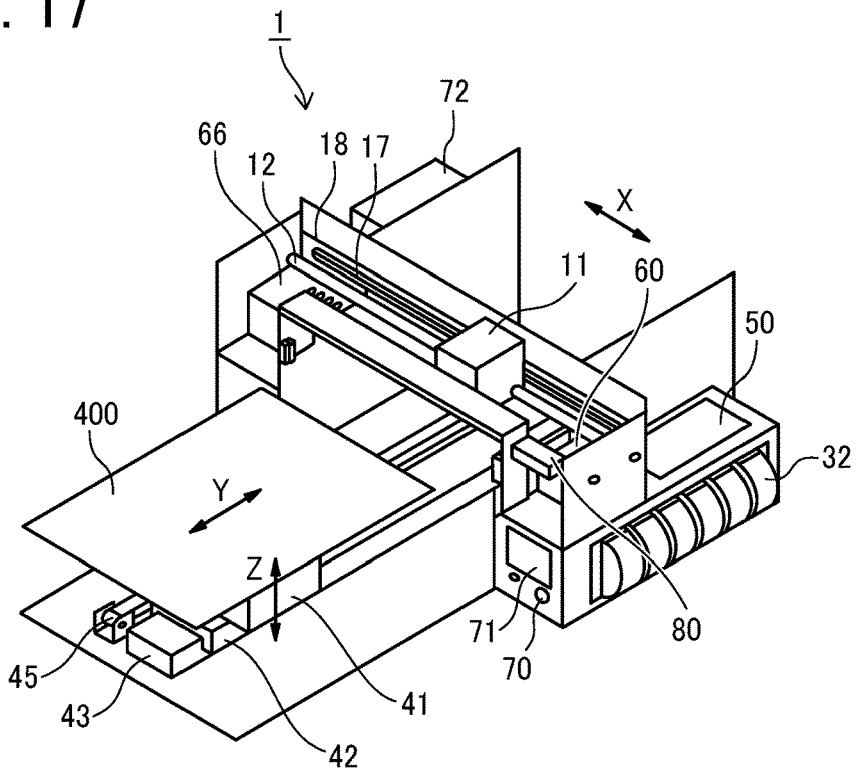
FIG. 17 is a schematic perspective view of a printer as a liquid discharge apparatus according to an embodiment of the present disclosure.

FIG. 17 is a schematic perspective view of a printer 1 according to the present embodiment.

Figure 18:
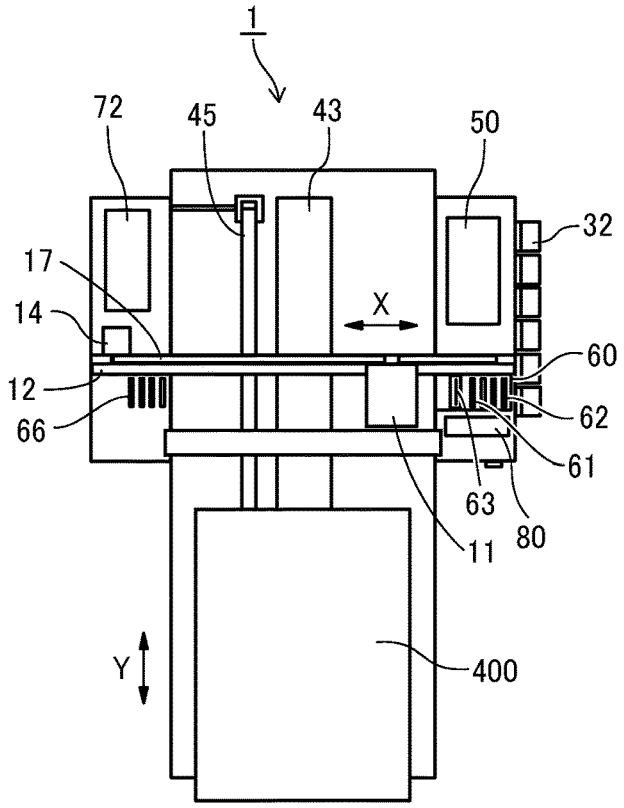
FIG. 18 is a schematic plan view of the printer as the liquid discharge apparatus of FIG. 17.

FIG. 18 is a schematic plan view of the printer 1 of FIG. 1.

Figure 19:
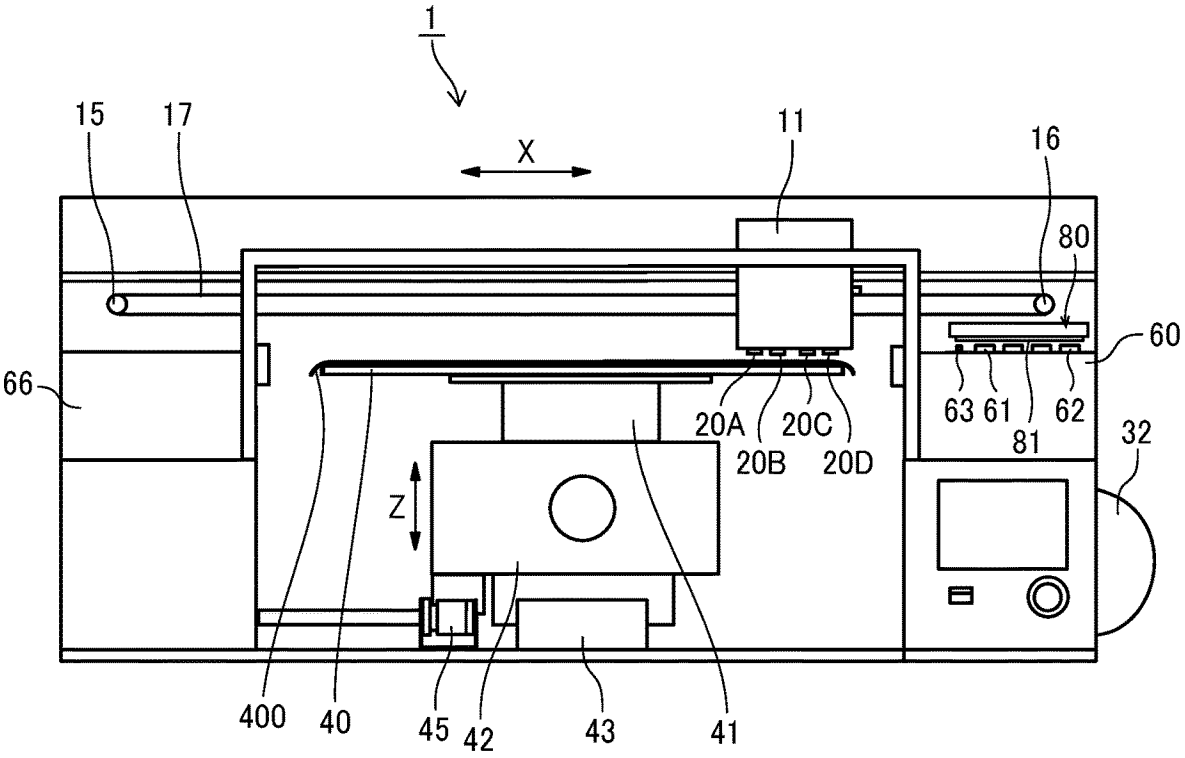
FIG. 19 is a schematic cross-sectional front view of the printer of FIG. 17.

FIG. 19 is a schematic cross-sectional front view of the printer 1 of FIG. 17.

The printer 1 includes a plurality of heads 20 (20A to 20D), a plurality of sub tanks, and the carriage 11. The plurality of heads 20 serves as liquid discharge devices to discharge a liquid. The carriage 11 mounts the sub tanks. The plurality of heads 20 (20A to 20D) includes a plurality of nozzle arrays. The plurality of heads 20 (20A to 20D) discharges, for example, a liquid of respective colors of black (K), cyan (C), magenta (M), and yellow (Y).

The printer 1 includes a guide 12 to hold the carriage 11 such that the carriage 11 is reciprocally movable in a main scanning direction indicated by arrow "X" in FIG. 1. To move and scan the carriage 11 in the main scanning direction X, the carriage 11 is coupled to a timing belt 17 stretched between a drive pulley 15 rotated by a main scanning motor 14 and a driven pulley 16. As the main scanning motor 14 drives and rotates the timing belt 17 through the drive pulley 15, the timing belt 17 reciprocally moves the carriage 11 in the main scanning direction X.

The printer 1 includes an encoder sheet 18 arranged along the main scanning direction X. The encoder sheet 18 includes a slit periodically formed on the encoder sheet 18. The carriage 11 includes a reading sensor that reads the slit in the encoder sheet 18. Thus, the printer 1 can detect a position of the carriage 11 in a main scanning direction indicated by arrow "X" from a reading result of the reading sensor.

The printer 1 includes a controller board 50 that controls the head 20 to discharge an ink as a liquid from the head 20 at a timing when the carriage 11 is moved to a discharge position. A position of the carriage 11 is obtained from the reading result of the reading sensor of the carriage 11.

The carriage 11 mounts sub tanks on the carriage 11 such that the sub tanks and heads 20A to 20C respectively form a single unit. The sub tanks temporarily store the liquid to be supplied to the heads 20A to 20C. The liquid is supplied from the main tank 32 to the sub tanks on the carriage 11.

The printer 1 includes a platen 40 as a holder to hold a fabric 400 as a print target (liquid application target). The printer 1 includes an elevator 41 on which the platen 40 is mounted. A position (height) of the elevator 41 is adjustable in a vertical direction indicated by arrow "Z." The printer 1 includes a slider 42 on which the elevator 41 is mounted. The printer 1 includes a slider rail 43 on which the slider 42 is movably mounted. The slider rail 43 is extended along on a sub scanning direction indicated by arrow "Y" The sub scanning direction Y is perpendicular to the main scanning direction X. Thus, the slider 42 moves along the slider rail 43 in the sub-scanning direction Y.

The slider 42 is reciprocally movable in the sub scanning direction Y via the timing belt 45 by a sub scan drive mechanism. Reciprocal movement of the slider 42 in the sub scanning direction Y reciprocally moves the platen 40 in the sub scanning direction Y.

The printer 1 includes the head maintenance device 60 to maintain and recover a discharge function the head 20. The head maintenance device 60 is disposed on one side (right-side in FIG. 17) of the printer 1 in the main scanning direction X. The head maintenance device 60 includes the suction cap 61 to cap the nozzle surface of the head 20, a moisture-keeping cap 62 to cap the nozzle surface of the head 20 to keep moisture in the nozzles of the head 20, and the wiper 63 to wipe the nozzle surface the head 20. The suction cap 61 is connected to a suction pump serving as a suction device.

The printer 1 includes the head maintenance device 60 that includes the cleaner 80 and a device to move the cleaner 80 as described in each of the above-described embodiments. The cleaner 80 cleans the suction cap 61 and the wiper 63.

The printer 1 includes a discharge receptacle 66 on another end of the printer 1 in the main scanning direction X. The controller board 50 controls the head 20 to discharge the liquid to the discharge receptacle 66 during printing to maintain and recover a discharge function of the head 20.

Further, the printer 1 includes a power button 70, an operation panel 71, a power supply unit 72, and the like.

When the printer 1 prints on a fabric (print target) such as a T-shirt, the fabric 400 is set on the platen 40. Then, the operation panel 71 is operated to completely pulls the platen 40 in a rear direction (upper righthand in FIG. 17) of the printer 1 by moving the slider 42.

When the platen 40 is fully (completely) pulled inside the printer 1 (end of pull-in operation), the printer 1 becomes a print-data standby state. The printer 1 starts a print operation when the printer 1 receives print data from an external information processing device. Alternatively, the printer 1 may select the print data by the operation panel 71 to start the print operation when the print data is previously stored in the controller board 50.

When the printer 1 starts the print operation, the printer 1 moves the slider 42 to move the platen 40 to a printing start position at which the printer 1 starts the print operation. Then, the printer 1 moves the carriage 11 while discharging a liquid from the head 20 to perform one line of printing on the fabric 400.

When the printer 1 prints one line, the printer 1 moves the slider 42 to move the platen 40 by one line. The printer 1 intermittently repeats one scanning movement of the carriage 11 in the main scanning direction X and one movement of the slider 42 in the sub-scanning direction Y to print an image on a desired region on the fabric 400. The printer 1 moves the platen 40 back to a front side (left side in FIG. 17) of the printer 1 to finish the print operation.

Although the printer in the above-described embodiments prints on the fabric, an object to be printed is not limited to the fabric. Further, the printer according to the present embodiments may also be applied to a printer that sets an object to be printed other than a fabric on a holder to print an image on the object to be printed.

The head maintenance device according to the present embodiment can improve cleanability to clean a cap and a wiper.

The term "liquid discharge apparatus" used herein also represents an apparatus including the head or the liquid discharge device to discharge liquid by driving the head. The liquid discharge apparatus may be, for example, an apparatus capable of discharging liquid to a material onto which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can adhere" include recording media, such as paper sheet, recording paper, recording sheet of paper, film, and cloth, electronic component, such as electronic substrate and piezoelectric element, and media, such as powder layer, organ model, testing cell, an interior and exterior components of a vehicle body, and an interior and exterior walls of buildings. The "material on which liquid can adhere" includes any material on which liquid can adhere, unless particularly limited.

Examples of the "material onto which liquid can adhere" include any materials on which liquid can adhere even temporarily, such as paper, thread, fiber, fabric, leather, metal, plastic, glass, wood, and ceramic.

Examples of the "liquid discharge apparatus" further include a treatment liquid coating apparatus to discharge a treatment liquid to a sheet to coat, with the treatment liquid, a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A head maintenance device comprising:

a cap to cap a nozzle surface of a head to discharge a liquid;

a wiper to wipe the nozzle surface of the head;

a holder to vertically movably hold the cap and the wiper to a height at which the cap and the wiper bite into an absorber; and a cleaner to move relative to the cap and the wiper, the cleaner comprising the absorber to contact and clean the cap and the wiper.

2. The head maintenance device according to claim 1, wherein the cap includes a contact surface and a side wall surface, and the contact surface contacts the nozzle surface of the head, and the cap is pressed against the cleaner to clean the contact surface and the side wall surface.

3. The head maintenance device according to claim 1, wherein a thickness of the absorber is larger than a height of an inner side wall surface of the cap.

4. The head maintenance device according to claim 3, wherein the thickness of the absorber is 1.2 times or more of the height of the inner side wall surface of the cap.

5. The head maintenance device according to claim 1, wherein hardness of the absorber is lower than hardness of the cap.

6. The head maintenance device according to claim 1, wherein the absorber has a rectangular parallelepiped shape.

7. The head maintenance device according to claim 1, wherein the absorber has a shape of a rotating body.

8. The head maintenance device according to claim 1, wherein the cleaner moves in a horizontal direction between the cap and the wiper.

9. The head maintenance device according to claim 1, of the cleaner, the wiper, the cap, and the head in a horizontal moving direction toward the head.

10. The head maintenance device according to claim 1, wherein the cleaner, the cap, and the wiper, and the head are arranged in an order of the cleaner, the cap, the wiper, and the head in a horizontal moving direction of toward the head.

11. The head maintenance device according to claim 1, wherein a width of the absorber is larger than a width of the cap in a longitudinal direction of the cap.

12. The head maintenance device according to claim 1, wherein the cap comprises a plurality of the caps, and a width of the absorber is larger than a total width of the plurality of caps in an arrangement direction of the plurality of caps.

13. The head maintenance device according to claim 1, wherein the cleaner moves in a horizontal direction to clean the cap and the wiper.

14. The head maintenance device according to claim 1, wherein the cleaner includes a cleaner holder including a slit penetrating through the cleaner holder, and one surface of the absorber is attached to the cleaner holder, and another surface of the absorber contacts the cap and the wiper.

15. The head maintenance device according to claim 1, further comprising:

a cleaning liquid application device to apply a cleaning liquid to one surface of the absorber opposite to another surface of the absorber to contact the cap and the wiper.

16. A liquid discharge apparatus comprising:

a head to discharge the liquid; and the head maintenance device according to claim 1.

17. A printer comprising:

the liquid discharge apparatus according to claim 16.

18. The head maintenance device according to claim 1, the cleaner concurrently cleans the wiper and the cap.

* * * * *